US007753322B1

(12) United States Patent
Peterson

(10) Patent No.: US 7,753,322 B1
(45) Date of Patent: Jul. 13, 2010

(54) PORTABLE BAG HOLDER EMPLOYING ELASTIC BAND

(76) Inventor: Carl S. Peterson, 2015 Grouse Butte La., Roseburg, OR (US) 97470

( * ) Notice: Subject to any disclaimer, the term of this patent is extended or adjusted under 35 U.S.C. 154(b) by 0 days.

(21) Appl. No.: 12/317,963

(22) Filed: Dec. 30, 2008

Related U.S. Application Data

(60) Provisional application No. 61/063,028, filed on Jan. 31, 2008.

(51) Int. Cl.
*B65B 67/04* (2006.01)

(52) U.S. Cl. ..... 248/99; 248/95; 248/97; 248/100; 248/101; 294/1.1; 294/1.3; 294/1.4; 294/55; 383/13; 383/33

(58) Field of Classification Search ..... 248/95, 248/97, 99, 100, 101; 294/1.1, 1.3, 1.4, 55; 383/13, 33
See application file for complete search history.

(56) References Cited

U.S. PATENT DOCUMENTS 2,462,973 A 3/1949 Kelrick
2,471,218 A * 5/1949 Jones ..... 248/100
3,614,041 A * 10/1971 Koger ..... 248/97
3,688,483 A * 9/1972 Hamilton ..... 56/400.11
3,711,141 A 1/1973 Soergel
3,733,099 A * 5/1973 Szita ..... 294/55
3,754,785 A * 8/1973 Anderson ..... 294/19.1
3,861,630 A * 1/1975 Ady ..... 248/100
3,872,831 A * 3/1975 Cassidy ..... 294/1.5
3,872,834 A * 3/1975 Fuhrman ..... 119/801
3,942,832 A * 3/1976 Haas, Jr. ..... 294/55
3,977,422 A * 8/1976 Cabaluna ..... 294/1.4
3,991,961 A * 11/1976 Platzer, Jr. ..... 248/99
4,026,340 A 5/1977 Sobolik
4,124,185 A 11/1978 Preisinger
4,146,260 A * 3/1979 Carrington ..... 294/1.5
4,238,868 A 12/1980 Sternberg
4,287,701 A * 9/1981 Washington ..... 53/390
4,312,489 A * 1/1982 Paetzold ..... 248/97
4,341,410 A * 7/1982 Summach ..... 294/1.3
4,358,083 A * 11/1982 Haubrich ..... 248/545
D271,718 S 12/1983 Johno, Jr. et al.
4,457,549 A 7/1984 Lowery
4,548,372 A 10/1985 Lutzker
4,630,752 A * 12/1986 DeMars ..... 220/495.08
4,723,803 A * 2/1988 Sapp ..... 294/55
4,738,478 A * 4/1988 Bean, Jr. ..... 294/55
4,768,742 A * 9/1988 Kaaloa ..... 248/99
4,805,858 A * 2/1989 Taylor ..... 248/99
4,832,292 A 5/1989 Beckham
4,867,401 A 9/1989 Graff
4,951,903 A * 8/1990 Frey ..... 248/99
5,050,920 A * 9/1991 Potticary ..... 294/55

(Continued)

*Primary Examiner*—Anita M King
*Assistant Examiner*—Nkeisha J Smith
(74) *Attorney, Agent, or Firm*—Chernoff, Vilhauer, McClung & Stenzel, LLP

(57) ABSTRACT

A device for holding a collapsible bag, such as a plastic trash bag, in an open and operable position. A rim supports the mouth of the bag, while a handle and forearm brace permit a user to hold it easily and without fatigue. The handle and brace are placed at the edge of the rim so as to leave the opening unobstructed and maximize versatility for both trash and leaf pickup.

1 Claim, 3 Drawing Sheets

U.S. PATENT DOCUMENTS

| | | | | | |
|---|---|---|---|---|---|
| D324,441 | S | | 3/1992 | Werner | |
| 5,139,219 | A | | 8/1992 | Navarro | |
| 5,149,028 | A | * | 9/1992 | Blackaby et al. | 248/101 |
| 5,193,770 | A | * | 3/1993 | Kildare | 248/97 |
| 5,217,271 | A | * | 6/1993 | Moe | 294/1.1 |
| 5,456,431 | A | * | 10/1995 | Ilnisky | 248/98 |
| 5,562,319 | A | * | 10/1996 | Kohler | 294/1.4 |
| 5,588,622 | A | * | 12/1996 | Gordon, Sr. | 248/101 |
| 5,711,563 | A | * | 1/1998 | Sapp | 294/1.1 |
| 5,718,400 | A | * | 2/1998 | Dwy | 248/99 |
| 5,857,722 | A | | 1/1999 | Ayotte | |
| 5,997,061 | A | | 12/1999 | Langley | |
| 6,086,022 | A | | 7/2000 | Dalton | |
| 6,131,861 | A | * | 10/2000 | Fortier et al. | 248/98 |
| 6,142,543 | A | * | 11/2000 | Friberg | 294/1.4 |
| 6,386,606 | B1 | * | 5/2002 | Marshall | 294/1.5 |
| 6,450,460 | B1 | | 9/2002 | Trahan | |
| 6,488,242 | B1 | * | 12/2002 | Barriere | 248/99 |
| 6,604,717 | B2 | * | 8/2003 | Stanfield | 248/99 |
| 6,623,056 | B1 | | 9/2003 | Wickson | |
| 6,691,959 | B1 | * | 2/2004 | Dancy | 248/100 |
| 7,007,991 | B1 | * | 3/2006 | Sapp | 294/1.1 |
| 7,011,278 | B1 | * | 3/2006 | Baldwin, III | 248/99 |
| D568,023 | S | | 4/2008 | McConnell | |
| 7,374,135 | B2 | * | 5/2008 | Romero | 248/99 |
| 7,708,236 | B2 | * | 5/2010 | Romero | 248/99 |
| 2004/0195467 | A1 | | 10/2004 | Passage | |
| 2005/0087657 | A1 | * | 4/2005 | Dran | 248/99 |
| 2005/0103952 | A1 | * | 5/2005 | Evans | 248/99 |
| 2006/0232083 | A1 | * | 10/2006 | Kamenkovich | 294/1.5 |
| 2007/0210216 | A1 | | 9/2007 | McConnell | |
| 2009/0230258 | A1 | * | 9/2009 | McFadden | 248/101 |

* cited by examiner

PORTABLE BAG HOLDER EMPLOYING ELASTIC BAND

CROSS REFERENCE TO RELATED APPLICATIONS

This application claims the benefit of provisional application No. 61/063,028, filed Jan. 31, 2008.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND

The present application relates to trash containers, and in particular relates to portable containers to facilitate the collection of trash and debris found on the ground.

Trash and other debris such as leaves falling from trees in autumn are frequently found scattered on the ground and in need of collection. Existing devices have a number of problems. Trash bags alone are floppy and do not stay open readily, frequently requiring two hands to hold them open. This does not leave a hand free to collect the item to be placed in the bag. Trashcans, although rigid, are bulky and cumbersome to move when collecting debris over a wide area, as along a highway. They are also difficult to transport and store.

Some portable solutions for this problem exist. For instance, both Langley (U.S. Pat. No. 5,997,061) and Passage (U.S. Pat. Pub. No. 2004/0195467) disclose a bag holder for facilitating collection of trash and leaves which can hold a bag open and provide a handle for a user.

However, users of these designs are likely to suffer considerable fatigue if they must carry them for long periods. The handle is located on one edge of the trash bag, and the result of this design is that entire torque exerted on the handle by the weight of the trash is borne by the wrist of the user. As the bag fills, it gets heavier and causes fatigue in muscles not adapted to holding heavy loads.

Moe (U.S. Pat. No. 5,217,271) shows a bag secured to a frame by elastic, the frame having two holes to accept trash and a handle between the holes to facilitate transportation. This design does not suffer from the torque problem, because the handle is horizontal and near the likely balance point for the trash in the bag. However, the openings of the Moe design, while adequate for picking up small pieces of trash in a park or on a highway, are poorly placed and too small to permit a user to easily rake or scoop large quantities of debris, such as autumn leaves.

What is needed, then, is a holder for a trash bag which is both comfortable for a user to hold for extended periods and versatile enough to be used for a variety of trash-removal operations.

SUMMARY

The present disclosure answers some of the shortcomings of the prior art by providing a trash bag holder with both a handle and a forearm support, allowing it to be carried for long periods when picking up trash, but leaving the mouth of the bag unobstructed for easy raking of large quantities when necessary.

The holder has a large hoop-like rim, which may have a channel on its outer perimeter. A bag may be secured to the rim quickly using an elastic band, which holds the bag in the channel. A handle attached to the edge of the rim allows for easy handling and control. A forearm support extends from the rim near the handle and passes under the forearm of the user, thus providing a counterbalance to the weight of the trash collected in the bag and allowing for easy long-term use. Because the handle is placed on the perimeter of the bag, a portion of the rim may be placed vertically on the ground to allow leaves to be swept into the bag in bulk.

The foregoing and other objectives, features, and advantages will be more readily understood upon consideration of the following detailed description taken in conjunction with the accompanying drawings.

BRIEF DESCRIPTION OF THE SEVERAL DRAWINGS

FIG. 1 is an isometric view showing the bag holder with a bag attached as in use.

FIG. 2. is a sectional view along line 2-2 in FIG. 1, depicting the channel-shaped hoop, the bag-retaining elastic tube, and the bag secured to the holder.

FIG. 3. is an isometric view of the bag holder with no bag, showing the exterior channel, the bag-retaining elastic in a disengaged position, and the pivoting retaining pins to which the elastic is mounted.

DETAILED DESCRIPTION OF EMBODIMENTS

Figure 1:
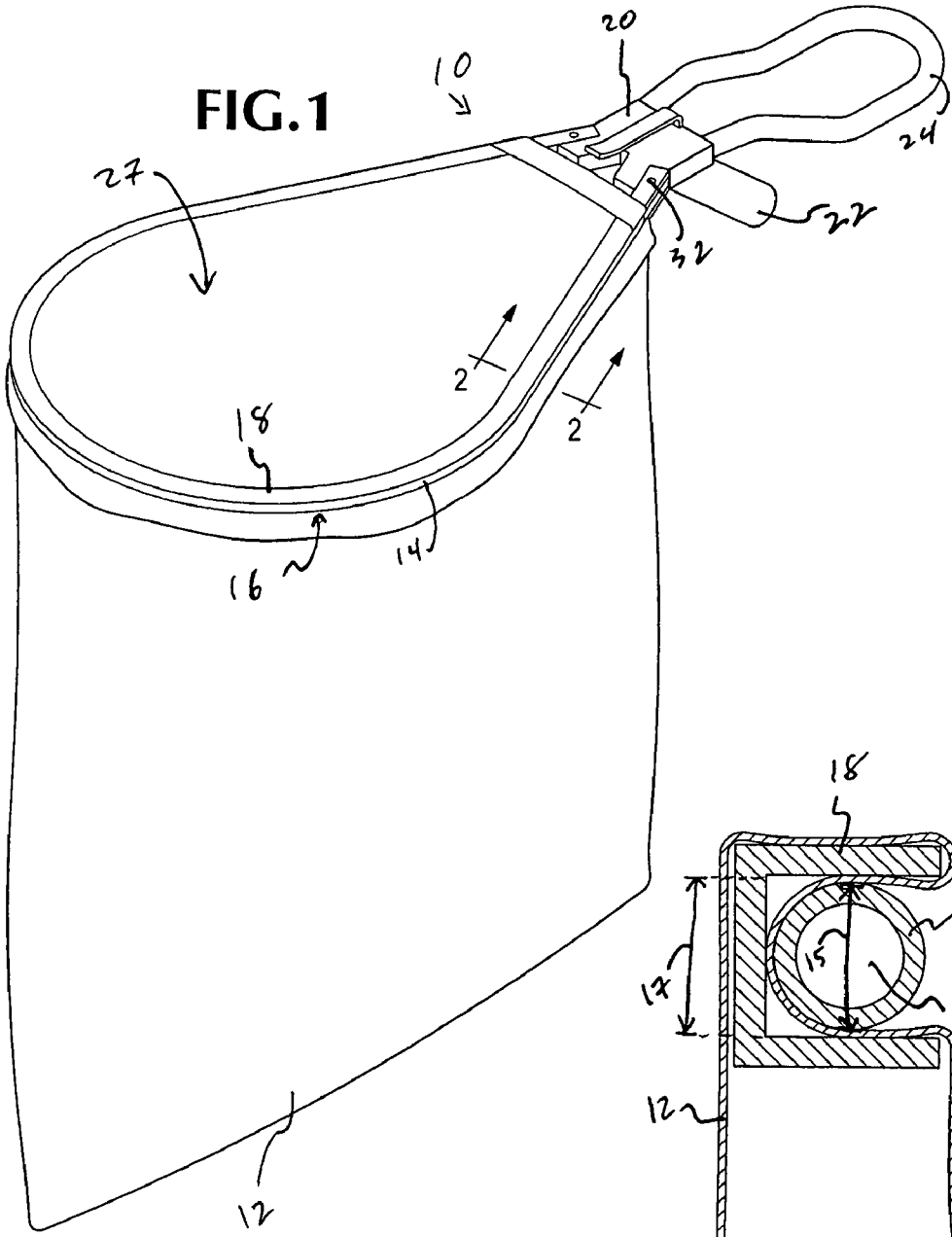
Figure 2:
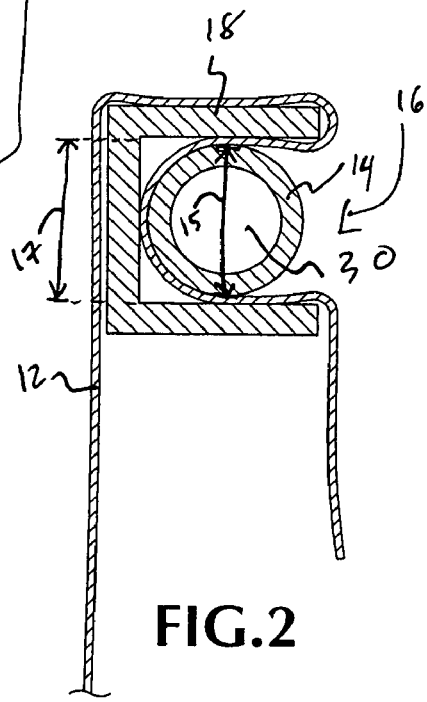
Figure 4:
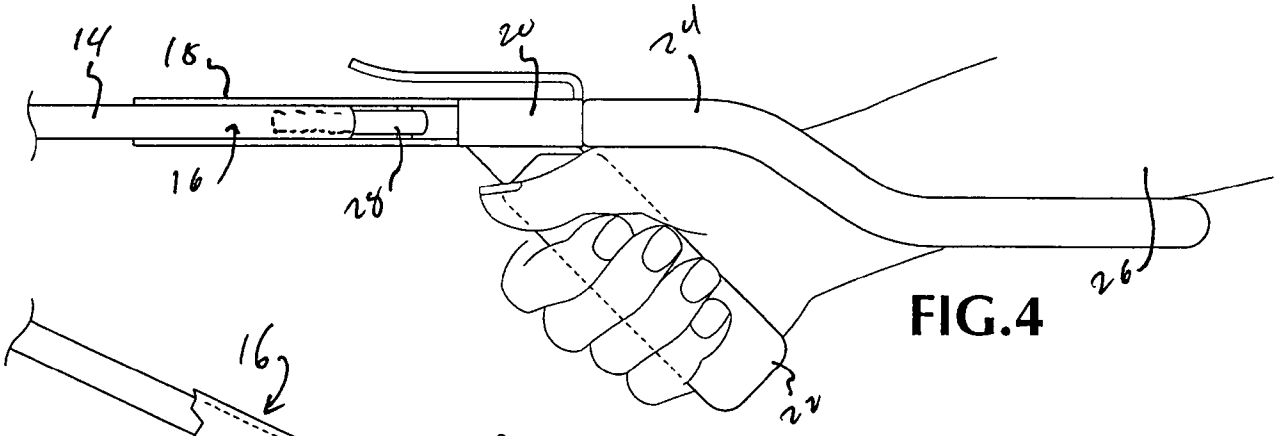
FIG. 4 is a side view of the rear portion of the bag holder, showing the handle and forearm brace in greater detail.
Figure 5:
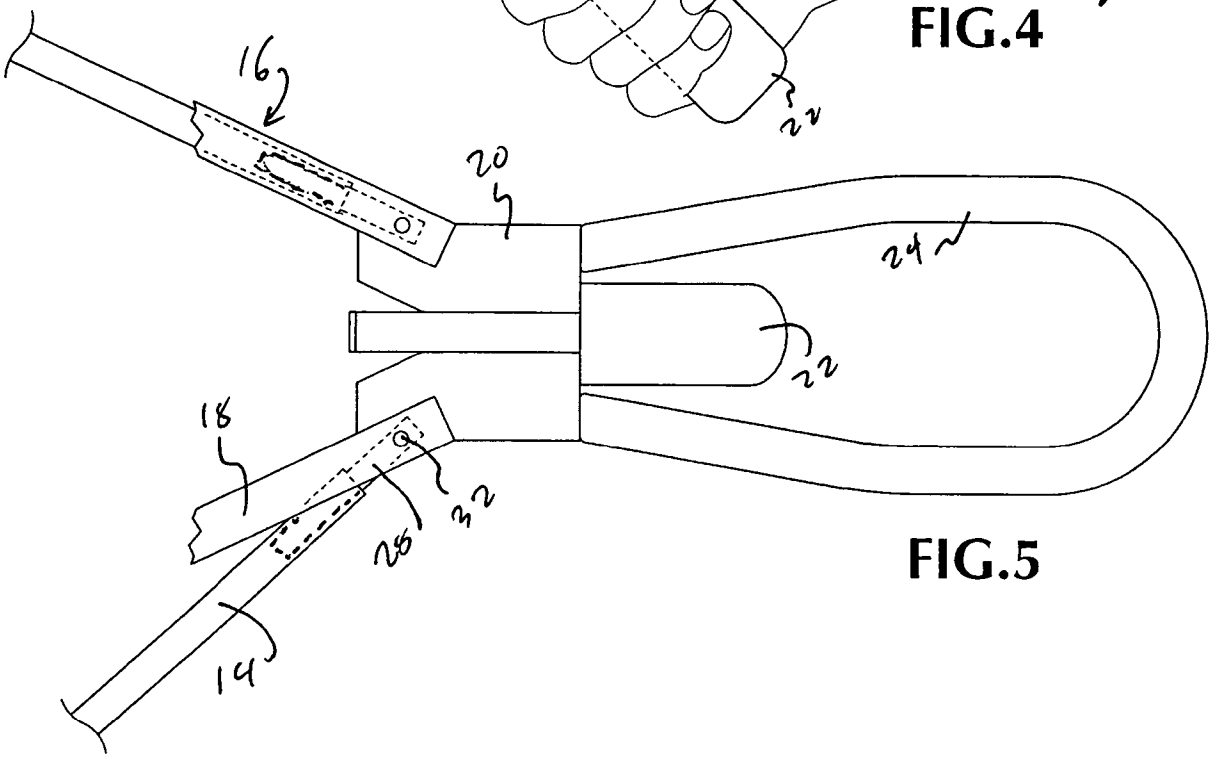
FIG. 5 is a top view of the rear portion of the bag holder, showing the handle, forearm brace, and elastic-retaining pins in greater detail.

Referring now to the drawings, FIG. 1 depicts a bag holder 10 with a trash bag 12 attached. The bag is secured by a loop of elastic material 14, for example rubber surgical tubing, placed in a channel 16 and extending along the perimeter of a hoop 18, as best shown in FIG. 2. The bag 12 may be composed of any pliable material, but is most commonly a thin plastic garbage bag, widely available for home and office use. The bag holder 10 may be composed of any suitably sturdy and rigid material or combination of materials, such as hard plastic, fiberglass, or metal, provided the material is both strong enough to bear the weight of the trash in the bag 12 and lightweight enough to be easily portable. In an exemplary embodiment, it is composed of aluminum. Attached to the hoop 18 is a plate 20, which serves as an attachment point for all elements of the bag holder 10. A handle 22 is attached to the plate 20 and angled for a comfortable and ergonomic grip. A conventional pistol-type grip is preferable because it does not require the user's wrist to bend when gripped. A forearm brace 24 extends from the plate 20 away from the hoop 18 and downward, to engage the underside of the forearm 26 of a user holding the handle 22, as best shown in FIG. 4.

The brace 24 acts as a cantilever to weight in the trash bag 12. The brace 24 may be formed of a loop of aluminum or other strong but lightweight material. The user's wrist is inserted through the loop in order to grip the handle 22. The user's hand then becomes a fulcrum with leverage provided by the brace 24 bearing against the underside of the user's forearm, all while the hand grips the handle in a comfortable position, that is without any bend in the wrist. This allows the forearm to bear the weight in the bag and takes pressure off the wrist. The downward displacement of brace 24 is selected to assure an approximately level bag mouth 27 when the user grips the handle 22 in a conventional manner.

Figure 3:
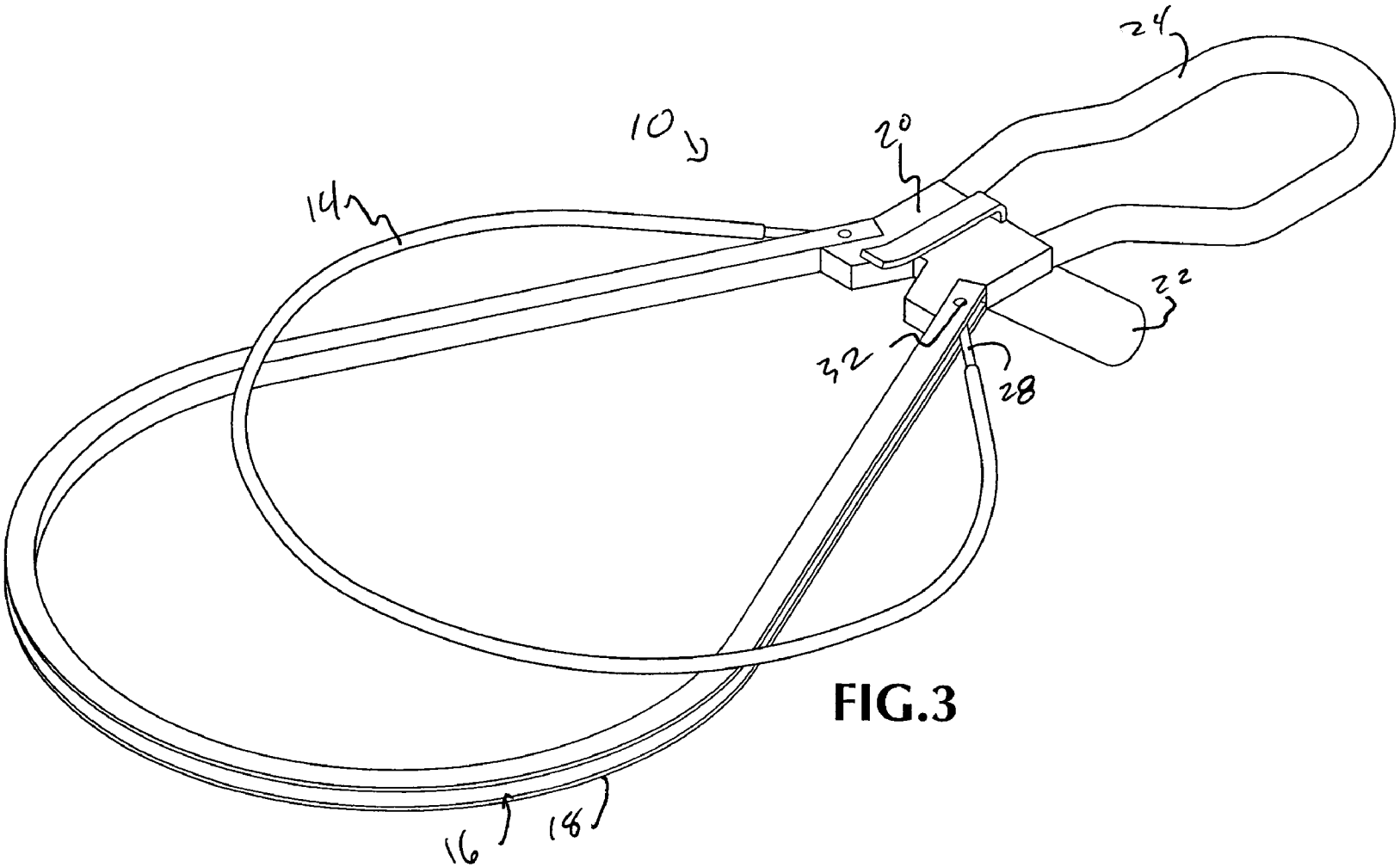

FIG. 3 shows the loop of elastic 14 removed from the channel 16. The loop of elastic 14 may so sized as to require some degree of stretching when at rest in the channel 16, to provide adequate frictional grip on the bag 12. The cross-sectional diameter 15 loop of elastic 14 may also be so sized as to be slightly larger than the width 17 of the channel 16, so as to deform and exert a slight outward force to improve the retention of bag 12. The loop of elastic 14 is may be attached to the bag holder 10 by any method, such as gluing, clamping, or tying. In an exemplary embodiment, the loop of elastic 14 is composed of hollow surgical tubing, and is secured by inserting the hollow center 30 of the tubing onto pivoting retaining pins 28. The pins 28 are so sized as to require the tubing to expand slightly and thus retain the tubing by friction. The pins 28 pivot about an axis 32 which is perpendicular to the rim so as to facilitate both attachment and removal of the bag 12 and replacement of the loop of elastic 14 should it become worn or damaged.

The handle 22 and brace 24 may be covered in a suitable elastomeric material to provide cushioning and/or temperature insulation.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A device for holding a collapsible bag in an open position, comprising:

(a) a rigid rim having a perimeter for supporting a bag in an opened position, (b) an attaching device for holding the bag in said open position about the rim;

(c) a handle coupled to said rim; and (d) a forearm support connected to said handle and extending away from said rim, said support being adapted to contact the forearm of a user; wherein said rim includes an outer peripheral channel, and an elastomeric band shaped to engage said channel while said bag is supported on said rim;

said elastomeric band comprises an elongate hollow tubular material and further includes attachment pins located adjacent said handle for engaging each end of said tubular material; and wherein said attachment pins pivot about an axis perpendicular to said rim.

* * * * *